US008393092B2

(12) United States Patent
Georgoulakis

(10) Patent No.: US 8,393,092 B2
(45) Date of Patent: Mar. 12, 2013

(54) FOOTBED SYSTEM AND FOOTWEAR CONSTRUCTION

(75) Inventor: Panagiotis Georgoulakis, Stamford, CT (US)

(73) Assignee: Nine West Development Corporation, Wilmington, DE (US)

( * ) Notice: Subject to any disclaimer, the term of this patent is extended or adjusted under 35 U.S.C. 154(b) by 614 days.

(21) Appl. No.: 12/582,338

(22) Filed: Oct. 20, 2009

(65) Prior Publication Data

US 2010/0269375 A1 Oct. 28, 2010

Related U.S. Application Data

(60) Provisional application No. 61/172,565, filed on Apr. 24, 2009.

(51) Int. Cl.
*A43B 13/38* (2006.01)

(52) U.S. Cl. ..... 36/24.5; 36/30 R; 36/44

(58) Field of Classification Search ..... 36/24.5, 36/43, 44, 30 R
See application file for complete search history.

(56) References Cited

U.S. PATENT DOCUMENTS

| | | | | | |
|---|---|---|---|---|---|
| 2,202,941 | A * | 6/1940 | Bastable | 36/34 R |
| 2,795,866 | A * | 6/1957 | Perugia | 36/24.5 |
| 3,153,865 | A * | 10/1964 | Steinbock | 36/24.5 |
| 3,414,988 | A * | 12/1968 | Mattos | 36/114 |
| 3,913,160 | A | 10/1975 | Funck | |
| 4,413,429 | A | 11/1983 | Power | |
| 4,586,273 | A * | 5/1986 | Chapnick | 36/44 |
| 4,633,598 | A * | 1/1987 | Moronaga et al. | 36/44 |
| 4,642,912 | A * | 2/1987 | Wildman et al. | 36/44 |
| 4,694,589 | A * | 9/1987 | Sullivan et al. | 36/44 |
| 4,831,750 | A | 5/1989 | Muller | |
| 4,835,884 | A * | 6/1989 | Bianchini et al. | 36/24.5 |
| 5,184,409 | A * | 2/1993 | Brown | 36/44 |
| 5,718,064 | A | 2/1998 | Pyle | |
| 6,205,683 | B1 | 3/2001 | Clark et al. | |
| 6,519,876 | B1 | 2/2003 | Geer et al. | |
| 6,536,137 | B1 * | 3/2003 | Celia | 36/28 |
| 6,662,469 | B2 | 12/2003 | Belley et al. | |
| 7,020,987 | B2 | 4/2006 | Issler | |
| 7,168,187 | B2 | 1/2007 | Robbins | |
| 7,178,266 | B2 | 2/2007 | Deem et al. | |
| 7,360,325 | B2 * | 4/2008 | Chen | 36/44 |
| 7,444,766 | B2 | 11/2008 | Mitchell | |
| 7,707,751 | B2 * | 5/2010 | Avent et al. | 36/150 |
| 2001/0001351 | A1 * | 5/2001 | Dieckhaus | 36/44 |
| 2002/0083618 | A1 * | 7/2002 | Erickson et al. | 36/44 |
| 2003/0088999 | A1 * | 5/2003 | Ailey et al. | 36/44 |
| 2004/0148804 | A1 | 8/2004 | Romano et al. | |
| 2006/0048414 | A1 | 3/2006 | Takada | |
| 2007/0209230 | A1 | 9/2007 | Dillon et al. | |
| 2007/0234590 | A1 * | 10/2007 | Morales et al. | 36/24.5 |
| 2007/0234592 | A1 * | 10/2007 | Crates | 36/44 |
| 2008/0127527 | A1 * | 6/2008 | Chen | 36/3 B |
| 2008/0209767 | A1 | 9/2008 | Seamans | |
| 2009/0094861 | A1 * | 4/2009 | Orvitz | 36/91 |
| 2010/0122475 | A1 * | 5/2010 | Purrington et al. | 36/3 B |

* cited by examiner

*Primary Examiner* — Marie Patterson
(74) *Attorney, Agent, or Firm* — Senniger Powers LLP

(57) ABSTRACT

A footbed for use in footwear. The footbed includes a first molded layer having a size and shape adapted to support at least a first portion of a foot of a wearer of the footwear. The first layer has a top surface and a bottom surface opposite the top surface. A second molded layer has a size and shape adapted to support at least a second portion of the foot of the wearer of the footwear. The second layer also has a top surface and a bottom surface opposite the top surface. A foam layer is attached to the top surface of the second molded layer. The foam layer and the second molded layer are positioned over at least a portion of the top surface of the first molded layer.

9 Claims, 5 Drawing Sheets

FOOTBED SYSTEM AND FOOTWEAR CONSTRUCTION

CROSS-REFERENCE TO RELATED APPLICATION

The present invention claims priority to U.S. Patent Application No. 61/172,565, filed Apr. 24, 2009, and entitled, "FOOTBED SYSTEM AND FOOTWEAR CONSTRUCTION", the entirety of which is hereby incorporated by reference.

BACKGROUND OF THE INVENTION

The present invention relates to footwear, and more particularly, to footwear having a heel and a footbed. Typically such footwear includes an outsole, an insole, and an upper. When constructing this type of footwear, the upper is drawn over a last and attached to an insole using adhesive, tacks, and/or stitching. An outsole is attached to the joined upper and insole using adhesive and/or stitching. A rigid shank is attached to the outsole to provide the footwear with stiffness between a heel portion of the outsole and a forward portion of the outsole that contacts the ground during use. A heel is attached to the outsole, usually with fasteners. Various other components such as a liner may also be attached to the shoe. Although this conventional construction provides rigid support for a wearer's foot, the construction does not absorb impact and the footwear may become uncomfortable after extended wear.

Athletic shoes are typically constructed using other techniques. In one technique, an upper is stretched over a last and attached to a foundation so the upper retains its shape. A sole is attached to the upper and foundation using conventional techniques such as vulcanization. In some athletic shoes, an engineered insole is inserted into the shoe so it rests on top of the foundation. Conventional athletic shoe insoles may be constructed of one or more types of foam providing soft areas for shock absorption and firm arms for support. For example, in some shoes, portions of the insoles intended to lie under an arch of a wearer are made from materials having greater resistance to compression so they support the arch. Other portions of the insoles such as those intended to lie under a heel of the wearer may be made with greater shock absorption. Still other portions of the insoles such as those intended to lie under metatarsal heads of the wearer may be provided with greater flexibility or cooling features. Although these insoles work well in athletic shoes, providing these features to heeled footwear such as high heel women's shoes, boots, and sandals has proven difficult without increasing complexity, weight, and/or cost of constructing the footwear.

SUMMARY OF THE INVENTION

In one aspect, the present invention is directed to a footbed for use in footwear comprising a first molded layer having a size and shape adapted to support at least a first portion of a foot of a wearer of the footwear. The first layer has a top surface and a bottom surface opposite the top surface. A second molded layer has a size and shape adapted to support at least a second portion of the foot of the wearer of the footwear. The second layer also has a top surface and a bottom surface opposite the top surface. A foam layer is attached to the top surface of the second molded layer. The foam layer and the second molded layer are positioned over at least a portion of the top surface of the first molded layer.

In another aspect, the invention is directed to a footbed for use in footwear comprising a molded layer having a top surface and a bottom surface opposite the top surface. The molded layer has a size and shape adapted to support at least a first portion of a foot of a wearer of the footwear. The footwear further comprises a cellular urethane foam layer attached to the top surface of the molded layer.

In yet another aspect, the invention includes footwear comprising an outsole having a top surface, a bottom surface, and a margin surrounding the top surface. Further, the footwear has a heel extending downward from the bottom surface of the outsole and an upper having a top edge and a bottom edge opposite the top edge. The bottom edge is attached to a foundation. The attached upper and foundation are attached to the top surface of the outsole. The footwear also includes a footbed received within an interior of the upper above the foundation.

In still another aspect, the invention is directed to a process for constructing footwear including an outsole, a shank, and a heel. The process comprises forming an upper over a last and strobel stitching edges of the upper to a foundation. The lower edges of the upper are bonded directly to the outsole of the footwear and the last is removed from the upper. A footbed is inserted into the upper.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
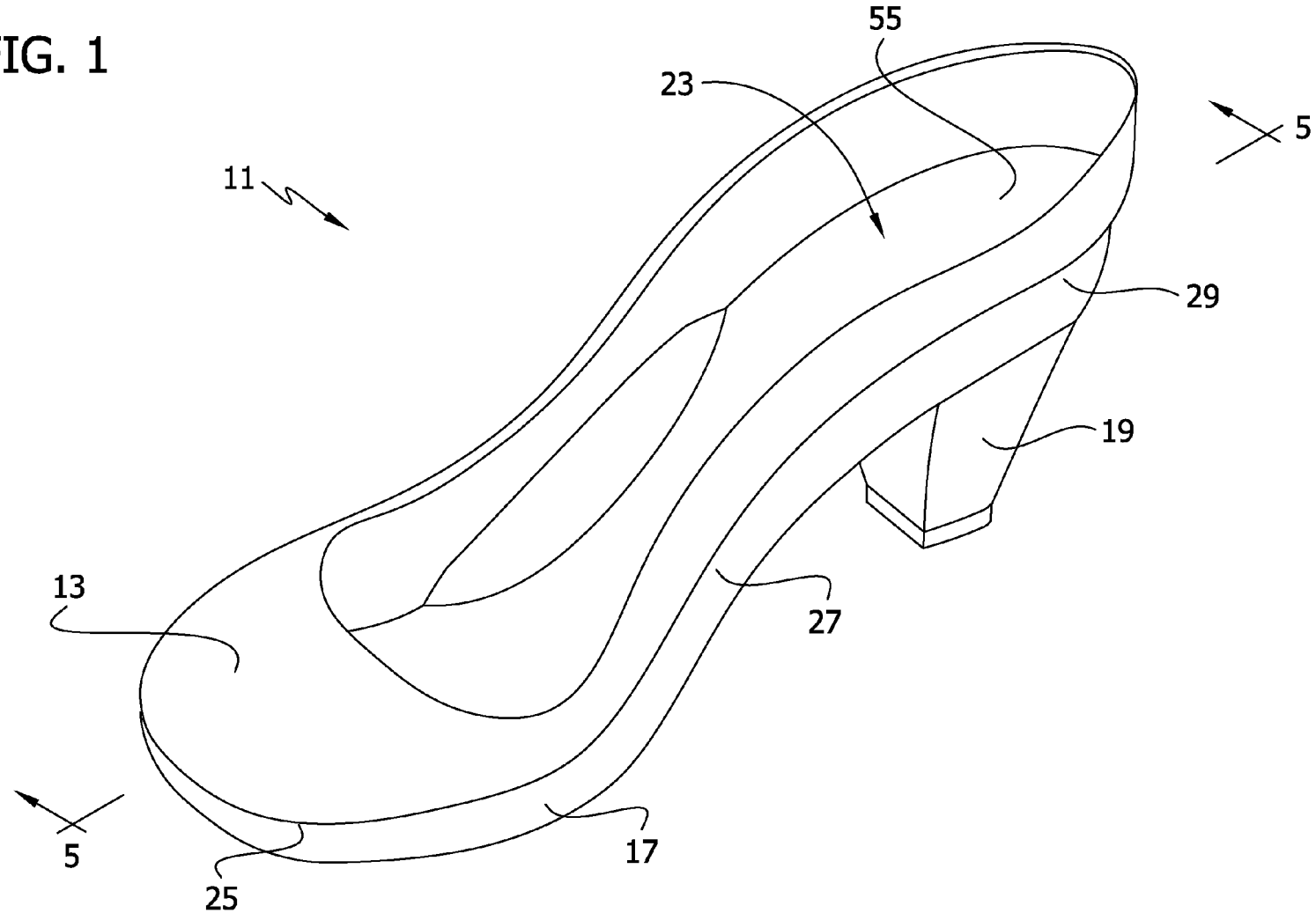
FIG. 1 is a perspective of footwear of the present invention.
Figure 2:
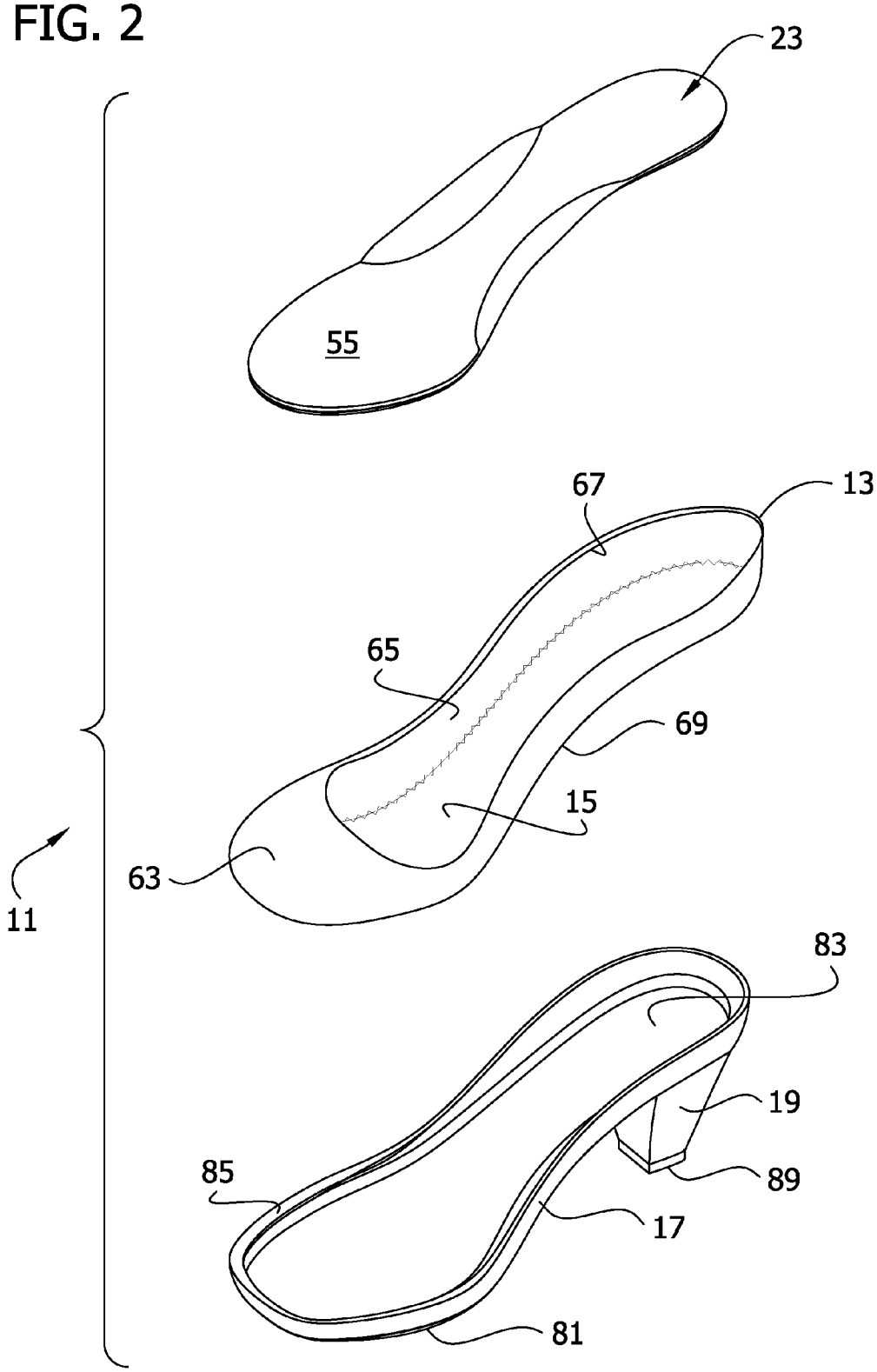
FIG. 2 is a partially separated view of the footwear.

Referring to FIGS. 1 and 2, footwear of the present invention is generally designated in its entirety by the reference number 11. The footwear 11 comprises an upper 13, a foundation 15 (FIG. 2), an outsole 17, a heel 19, and a footbed, generally designated by 23. The footwear 11 has a forepart 25 intended to generally surround toes of a wearer, a mid-part 27 intended to generally surround an arch of the wearer, and a back part 29 intended to generally surround a heel of the wearer. It is envisioned that the footwear 11 may include other components, such as a midsole or a heel cup, without departing from the scope of the present invention.

Figure 3:
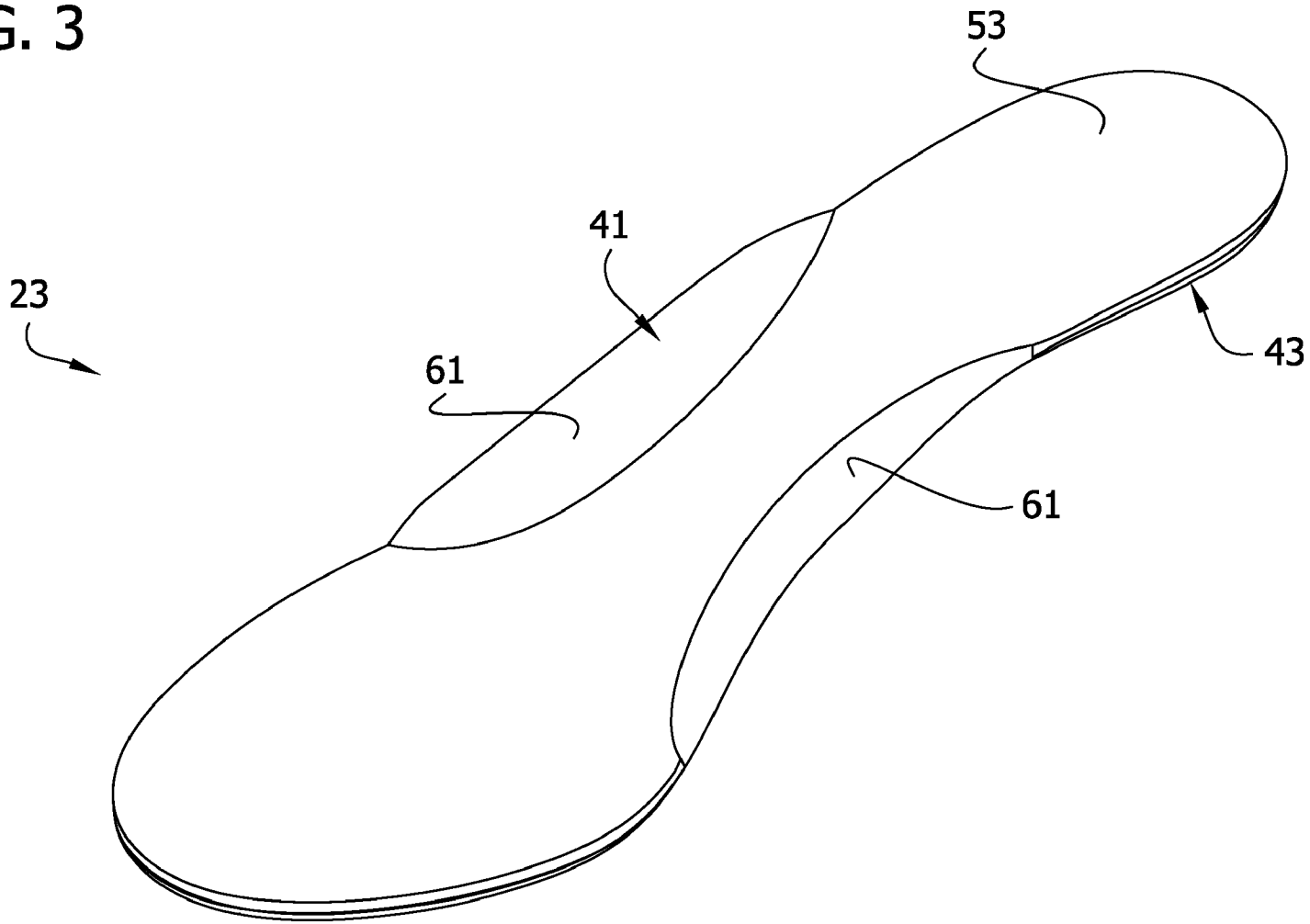
FIG. 3 is a perspective of a footbed of the footwear absent a sockliner for clarity.
Figure 4:
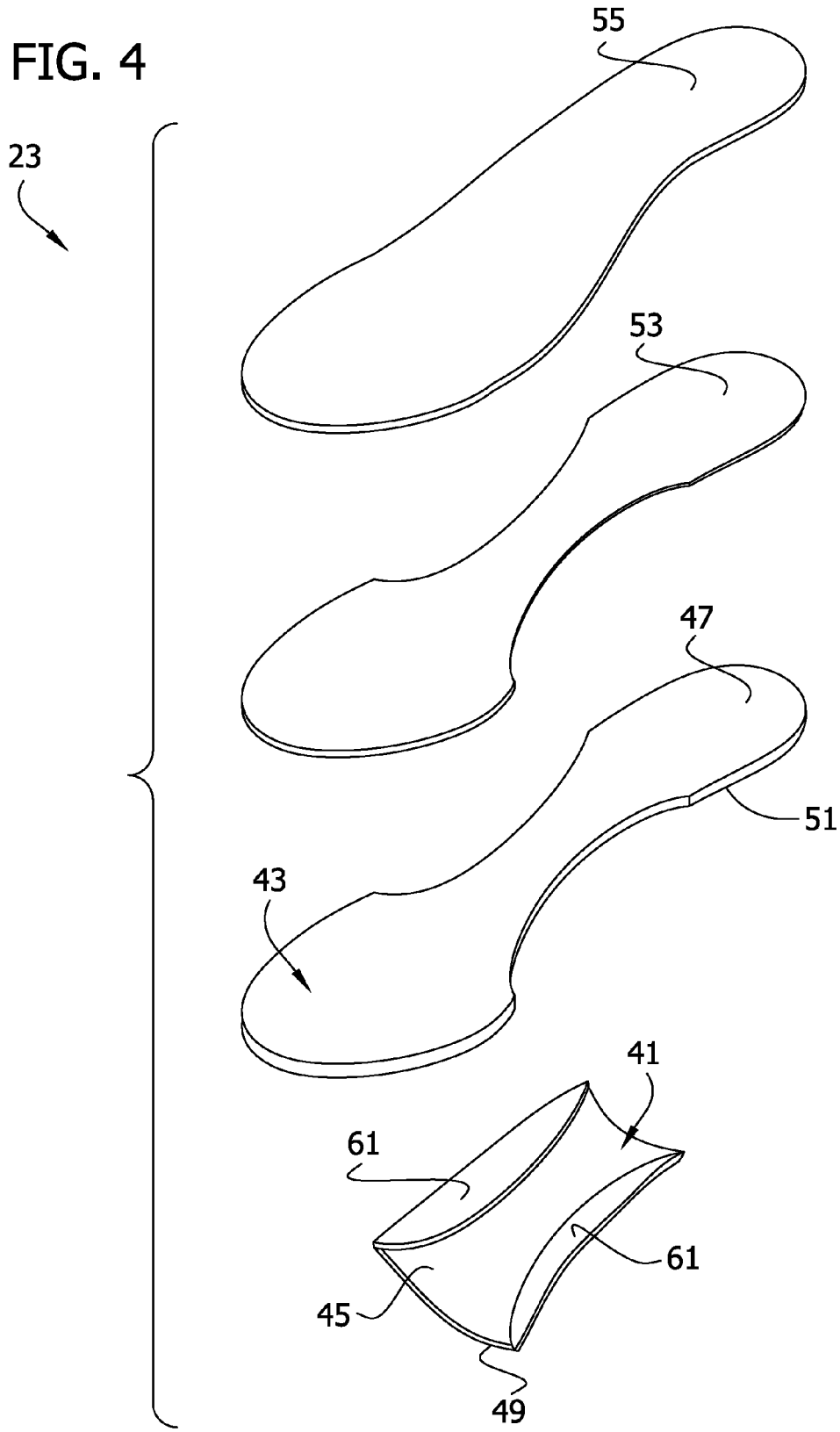
FIG. 4 is a separated view of the footbed.

Referring to FIGS. 3 and 4, the footbed 23 of some embodiments includes first and second molded layers, generally designated by 41, 43, respectively. Each of the molded layers 41, 43 has a top surface 45, 47, respectively, and a bottom surface 49, 51, respectively. Although the layers 41, 43 may be made from other materials without departing from the scope of the present invention, in some embodiments the layers comprise molded polyurethane. In some embodiments, the first molded layer 41 is intended to lie under an arch of a wearer and may have a greater stiffness and/or resistance to compression than the second molded layer 43. In some embodiments, the second molded layer 43 may be made from a material selected to absorb shock. A porous foam layer 53 is attached to the top surface 47 of the second molded layer 43. As shown in FIG. 4, a conventional sock liner 55 covers the porous foam layer 53 and the exposed top surfaces of the second molded layer 43 to provide a finished lining for a bottom interior surface of the footwear 11. Those skilled in the art will appreciate that other layers may be provided to the footbed 23 without departing from the scope of the present invention. Further, the materials used to make the footbed 23 may be selected for other characteristics, such as odor and moisture absorption, without departing from the scope of the present invention.

It will be appreciated that the first molded layer 41 is disposed mostly in the mid-part 27 of the footwear 11. Therefore, the first molded layer 41 primarily supports a mid-foot of a wearer of the footwear 11. The second molded layer 43 and the foam layer 53 lie under substantially all of a foot of the wearer except along side margins of the footbed 23 generally underlying the mid-foot of the wearer. Further, the second molded layer 43 and the foam layer 53 extend the entire length of the footwear 11 (see FIG. 5). Thus, the second molded layer 43 and the foam layer 53 support the forefoot, the mid-foot, and the heel of the wearer. It is envisioned that in some embodiments the layers of the footbed could have other lengths and positions along the foot without departing from the scope of the present invention.

In the illustrated embodiment, the first molded layer 41 is formed from slow rebound, open cell, polyurethane foam. The second molded layer 43 is formed from a molded piece of dual-density polyurethane, and the porous foam layer 53 is made of stacked Poron® radiant grade microporous urethane foam. Poron is a U.S. federally registered trademark of World Properties, Inc., an Illinois corporation having a place of business in Lincolnwood, Ill. It is envisioned that other types of molded layers and foams could be used without departing from the scope of the invention.

The first molded layer 41 includes a pair of elevated portions 61 extending upward and laterally beside the second molded layer 43 and foam layer 53 except along side margins of the footbed 23 generally underlying the mid-foot of the wearer. The elevated portions 61 define an arch support of the footbed 23. The footbed 23 may be formed to have other contours without departing from the scope of the present invention.

The upper 13 forms the top of the footwear 11. The upper 13 includes an outer surface 63, an inner surface 65, and top and bottom edges 67, 69, respectively. An opening defined generally by the top edge 67 of the upper 13 is sized and shaped to receive the foot of the wearer and to generally surround an ankle of the wearer. The upper 13 may be made from a wide variety of materials including leather as is well known in the art.

The upper 13 is stretched over a conventional last (not shown) and the foundation 15 is attached to the bottom edge 69 of the upper so the upper retains its finished shape when the last is removed. Although the foundation 15 may be made from other materials without departing from the scope of the present invention, in one embodiment the foundation is made from a conventional nonwoven material such as a fiberboard material. Although the foundation 15 may be attached to the upper 13 using other techniques, in some embodiments the upper is strobel stitched to the foundation 15 as illustrated in FIG. 2. It is envisioned that other conventional methods of attaching the upper 13 and foundation 15 may be used without departing from the scope of the present invention. Although not shown, the inner surface 65 of the upper 13 may be lined with a conventional liner material using conventional techniques without departing from the scope of the present invention. Likewise, the upper edge 67 of the upper 13 may be finished using conventional techniques.

Figure 5:
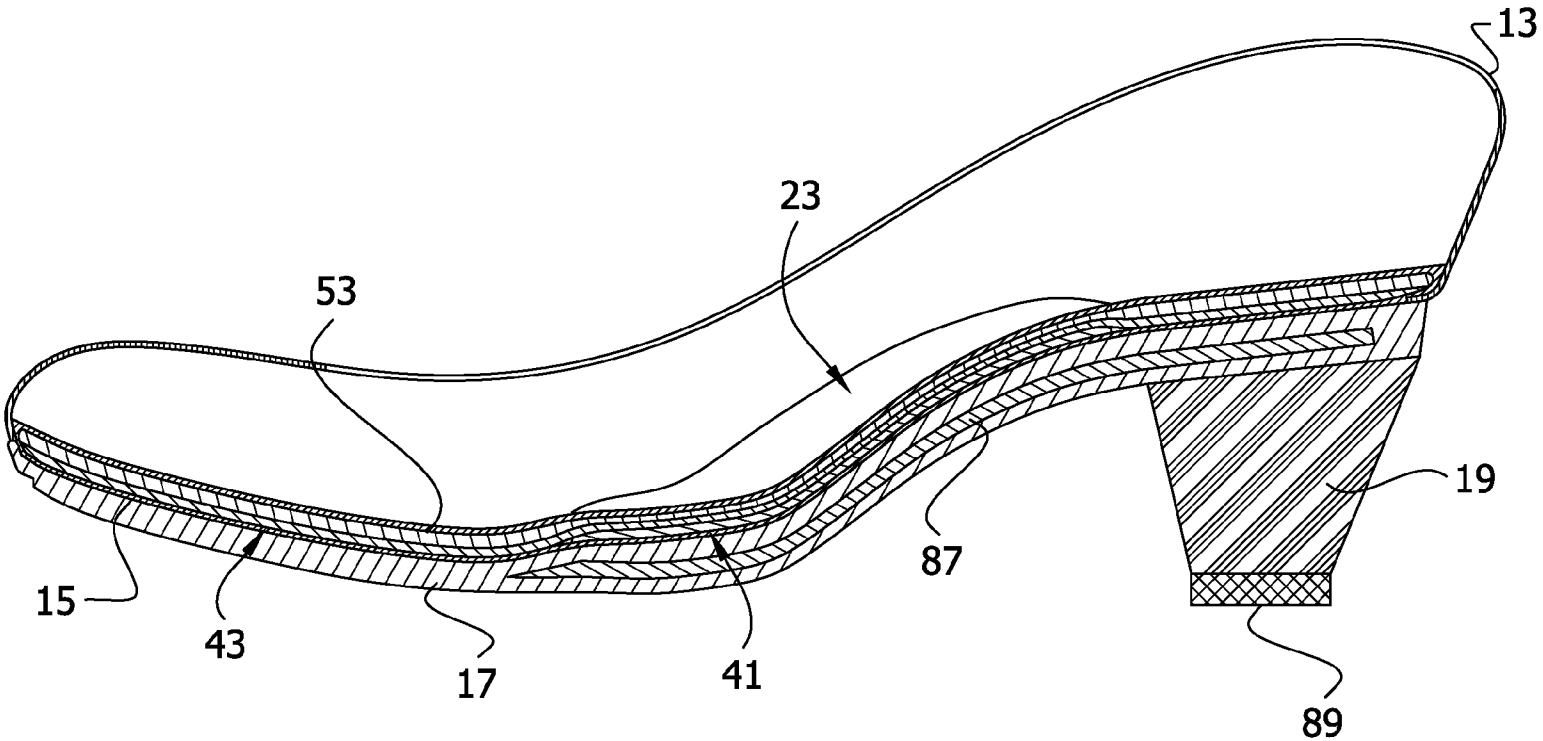
FIG. 5 is a section taken through a plane including line 5-5 of FIG. 1.

The outsole 17 forms a ground contacting portion of the footwear 11. The outsole 17 has a bottom surface 81, a top surface 83 opposite the bottom surface, and a margin 85 extending around the top surface. In the illustrated embodiment, the outsole 17 is made from polyurethane molded around a steel or rigid plastic shank 87 as shown in FIG. 5. The shank 87 is provided to support the wearer's foot and is of particular importance in footwear having prominent heels such as women's high heel shoes. As will be appreciated by those skilled in the art, the outsole 17 can be made from a variety of materials including synthetic rubber or leather as is well known in the art. The heel 19 forms another ground contacting portion of the footwear 11. The heel 19 is attached to a back part 29 of the bottom of the outsole 17 by conventional means such as with mechanical fasteners (not shown) as is well known in the art. The heel 19 may be made from a variety of well known materials without departing from the scope of the present invention. The heel 19 may also include a wear resistant and/or friction tip 89 as shown. The footbed 23 is inserted into the interior of the footwear 11. In some embodiments, the footbed 23 is removable to permit easy replacement.

In some embodiments, the outsole 17 is attached to the upper 13 and foundation 15 using a suitable adhesive or by vulcanizing. This construction deviates from a typical footwear having a shank and a heel. In this typical footwear, the upper is attached, at least partially along its length, to an insole, and the insole is then attached to the outsole. The footwear 11 of the present invention is constructed without a conventional insole. Therefore, rather than attaching the upper 13 to the footbed 23 as taught by conventional practices, the upper is attached directly to the outsole, allowing the footbed to be removed for repair or replacement.

The footwear 11 is constructed by strobel lasting, a form of slip lasting where the upper 13 is stitched around its lower edge 69 to the foundation 15. The upper is then cemented to the margin 85 of the outsole 17 and the last is removed. Strobel lasting is well known to those skilled in the art. The footwear of the prior art, however, at least partially attaches the upper to the insole during construction. The lasting process of the present invention does not use an insole, and the upper is not attached to the footbed 23.

Having described the invention in detail, it will be apparent that modifications and variations are possible without departing from the scope of the invention defined in the appended claims.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A footbed for use in footwear comprising:

a first molded layer having a size and shape adapted to support at least a first portion of a foot of a wearer of the footwear, said first layer having a top surface and a bottom surface opposite the top surface;

a second molded layer having a size and shape adapted to support at least a second portion of the foot of the wearer of the footwear, said second layer having a top surface and a bottom surface opposite the top surface; and a foam layer attached to the top surface of the second molded layer, the foam layer having an upper surface opposite the top surface of the second molded layer, the foam layer and the second molded layer being positioned over at least a portion of the top surface of the first molded layer;

wherein only part of said first molded layer is co-extensive with said second molded layer; and wherein only part of said second molded layer is co-extensive with said first molded layer.

2. A footbed as set forth in claim 1 further comprising:

a sockliner covering the upper surface of the foam layer and the second molded layer;

wherein the sockliner, foam layer, and second molded layer are positioned over at least a portion of the top surface of the first molded layer.

3. A footbed as set forth in claim 2 wherein:

the first molded layer comprises a polyurethane foam;

the second molded layer comprises molded polyurethane; and the foam layer comprises microporous foam material.

4. A footbed as set forth in claim 1 wherein the first molded layer comprises at least one wing defining an arch support.

5. A footbed as set forth in claim 4 wherein the first molded layer comprises an elevated portion.

6. A footbed as set forth in claim 5 wherein:

the first molded layer comprises at least two elevated portions; and the foam layer and second molded layer are positioned between the elevated portions.

7. A footbed as set forth in claim 1 in combination with:

an outsole having a heel;

an upper secured around the outsole and forming an interior of footwear; and a shank positioned above the heel;

wherein the footbed is inserted into the interior of the footwear and placed over the outsole and shank.

8. A footbed for use in footwear comprising:

a first molded layer having a top surface and a bottom surface opposite said top surface, said first molded layer having a size and shape adapted to support at least a first portion of a foot of a wearer of the footwear;

a second molded layer having a top surface and a bottom surface opposite said top surface, said second molded layer having a size and shape adapted to support at least said first portion of the foot of the wearer of the footwear; and a microporous urethane foam layer attached to the top surface of the second molded layer;

wherein only part of said first molded layer is co-extensive with said second molded layer; and wherein only part of said second molded layer is co-extensive with said first molded layer.

9. A footbed as set forth in claim 8 wherein the foam layer and said second molded layer are positioned above at least a portion of the top surface of the first molded layer.

* * * * *